US009604775B2

(12) United States Patent
Price et al.

(10) Patent No.: US 9,604,775 B2
(45) Date of Patent: Mar. 28, 2017

(54) BEVERAGE CONTAINER

(71) Applicant: Diageo Ireland, Dublin (IE)

(72) Inventors: Stephen Geoffrey Price, Derbyshire (GB); Amy Heintz, Dublin, OH (US); Adeline Lay Kuen Koay, Essex (GB)

(73) Assignee: Diageo Ireland, Dublin (IE)

( * ) Notice: Subject to any disclaimer, the term of this patent is extended or adjusted under 35 U.S.C. 154(b) by 60 days.

(21) Appl. No.: 14/421,478

(22) PCT Filed: Aug. 14, 2013

(86) PCT No.: PCT/EP2013/066999

§ 371 (c)(1),
(2) Date: Feb. 13, 2015

(87) PCT Pub. No.: WO2014/027028

PCT Pub. Date: Feb. 20, 2014

(65) Prior Publication Data

US 2015/0217933 A1 Aug. 6, 2015

(30) Foreign Application Priority Data

Aug. 14, 2012 (GB) ..... 1214488.7

(51) Int. Cl.
*B65D 85/73* (2006.01)
*B65B 7/28* (2006.01)
(Continued)

(52) U.S. Cl.
CPC ..... *B65D 85/73* (2013.01); *A47G 19/2233* (2013.01); *B65B 3/04* (2013.01); *B65B 7/2842* (2013.01)

(58) Field of Classification Search
CPC .. A47G 19/2233; B65D 85/73; B65B 7/2842; B65B 3/04
See application file for complete search history.

(56) References Cited

U.S. PATENT DOCUMENTS 5,788,111 A * 8/1998 Waugh ..... A47G 19/2233 220/608
2002/0000678 A1 1/2002 Takai
(Continued)

FOREIGN PATENT DOCUMENTS

EP 0360374 3/1990
FR 2531891 8/1982
(Continued)

OTHER PUBLICATIONS

Johnston, Non-Equilibrium Molecular Dynamics Simulation of Bubble Nucleation in Nanocavities, Aug. 2011, University of Arkansas.*

(Continued)

*Primary Examiner* — Viren Thakur
*Assistant Examiner* — Thanh H Nguyen
(74) *Attorney, Agent, or Firm* — Scherrer Patent & Trademark Law, P.C.; Stephen T. Scherrer; Monique A. Momeault

(57) ABSTRACT

A beverage container or package that includes an internal surface for promoting nitrogen bubble nucleation and growth. The surface incorporates a plurality of nanoscale structures, e.g. between 6 and 100 nanometers in size. Most preferably the structures are pits, greater than 15 nm in depth/height. Upon opening the container filled with a Nitrogen (and carbon dioxide) supersaturated beverage, a foaming effect occurs which provides a desirable head of fine bubbles when transferred to a drinking glass.

13 Claims, 9 Drawing Sheets

(51) Int. Cl.
*B65B 3/04* (2006.01)
*A47G 19/22* (2006.01)

(56) References Cited

U.S. PATENT DOCUMENTS

| | | | | |
|---|---|---|---|---|
| 2010/0104697 | A1 | 4/2010 | Kriegel | |
| 2012/0100266 | A1* | 4/2012 | Nicholson ..... | B65D 17/165 426/115 |

FOREIGN PATENT DOCUMENTS

| | | |
|---|---|---|
| GB | 2136679 | 9/1984 |
| GB | 2258802 | 2/1993 |
| GB | 2273693 | 6/1994 |
| GB | 2420961 | 6/2006 |
| JP | 62109859 | 11/1985 |
| WO | 94/12083 | 6/1994 |
| WO | 95/00057 | 1/1995 |
| WO | 2012/054203 | 4/2012 |

OTHER PUBLICATIONS

Brennen, Cavitation and Bubble Dynamics, 1995, Oxford University. p. 29.*

Witharana et al, Bubble Nucleation on Nano- to Micro-size cavities and Posts: An experimental validation of classical theory, Journal of Applied Physics. Pub. Sep. 2012.*

EP Search Report mailed Feb. 23, 2016.

M.G.Devereux and W.T.Lee, "Mathematical Modelling of Bubble Nucleation in Stout Beers and Experimental Verification," Proceedings of the World Congress on Engineering 2011, vol. I, WCE 2011, Jul. 6-8, 2011, London, U.K.

W.T. Lee, J.S. McKechnie and M.G. Devereux, "Bubble Nucleation on Stout Beers," MACSI, Department of Mathematics and Statistics, University of Limerick, Limerick, Ireland, Mar. 29, 2011.

* cited by examiner

Cell at an angle to allow the bubbles to rise (single plane)

Example image

*Target Rates (bubbles / mm² s)*

| | Bottom Only (44 cm²) | Walls of Can (180 cm²) |
|---|---|---|
| 30 sec contact | 512 | 124 |
| 1 min contact | 256 | 62 |
| 2 min contact | 128 | 30 |

Pillars in PLGA (Trinity)

- Created by imprinting AAO (and other patterns?) into PLGA to create nanostructured pillars (~200 nm height)
  - 40 nm diameter pillar / 90 nm interparticle distance / CA = 125
  - 70 nm diameter pillar / 150 nm interparticle distance / CA = 110
  - 50 nm diameter pillar / 140 nm interparticle distance / CA = 100

| Sample (100 $cm^2$) | Head Height (mm) | Nucleation Quality | Head Height after Ultrasound (mm) |
|---|---|---|---|
| Wet AAO | 4 | 0 | 15 |
| Dry AAO | 12 | 1 | 14 |
| Tyvek | < 1 mm | 0 | 15 |

BEVERAGE CONTAINER

TECHNICAL FIELD

The present invention relates to a beverage container or, more specifically, a surface to be incorporated into a beverage package/container that promotes bubble nucleation and growth.

BACKGROUND ART

Some beverage products rely on bubble formation to achieve taste characteristics and/or visual appeal. For example, carbonated beverage products naturally generate carbon dioxide bubbles activated by the pressure change when a container is opened and/or during pouring; however, other products such as stout beer rely on dissolved nitrogen to come out of solution and create a distinctive taste and fine creamy "head" in a poured glass. The formation of bubbles in a stout beer is a far less naturally active process than a carbonated product and, as such, an additional nucleation means is required. Stout beers of this type contain a mixture of nitrogen and carbon dioxide but, at the serving temperature, the amount of dissolved carbon dioxide is below its equilibrium level so there is no tendency for it to come out of solution.

The characteristic experience of stout beer, where bubble formation needs to be initiated during pour to form a creamy, white head, and its smoothness of taste (as opposed to a more acidic taste influenced by carbonation) is currently produced by one of three methods: (1) flow through a restrictor plate in a draught dispenser; (2) cavitation of stout in the glass by way of an ultrasonic unit; or (3) injection of gas/liquid via a "widget" in a bottle or can. These methods are proven effective, but all require systems that are not easily incorporated into packaging. For example, production of cans to emulate the draught effect via a widget requires specialized capital equipment, as well as economic losses associated with the slower canning speeds compared to traditional canned beverages. The canned stout provided for use with ultrasonic systems is the same as the product supplied in kegs but obviously requires additional apparatus (i.e. the ultrasonic unit) to be operated by a barman or at home by a consumer.

Nucleation and growth of carbon dioxide bubbles in beverages is well documented (see (1) Jones, S. F.; Evans, G. M.; Galvin, K. P. "Bubble nucleation from gas cavities—a review," *Adv. Coll. Inter. Sci.* 1999, 80, 27-50; (2) Jones, S. F.; Evans, G. M.; Galvin, K. P. "The cycle of bubble production from a gas cavity in a supersaturated solution," *Adv. Coll. Inter. Sci.* 1999, 80, 51-84). It has also been noted that cellulose fibres present in glasses promote carbon dioxide bubble growth and, as such, the possibility of providing a special surface on a wall inside a container to encourage bubble nucleation and growth has been proposed for nitrogen supersaturated products such as stout (Lee, W. T.; McKechnie, J. S.; Devereux, M. "Bubble nucleation in stout beers," Phys. Rev. E, 2011, 83, 051609).

The research further concludes that Type 4 nucleation (as defined by Jones et al) occurs at a lower degree of supersaturation than other types of heterogeneous nucleation. Type 4 nucleation occurs from pre-existing nuclei, e.g. trapped gas, which is present on a surface.

The concept of using structured cellulose surfaces to enhance bubble nucleation and growth is supported by experimental studies in stout beer. Cellulose fibres are multi-scale structures comprised of hollow tubes with an inner lumen diameter of 1-10 μm and multilayer walls consisting of densely packed microfibrils. However, while cellulose shows efficacy, it is not an ideal material for a container surface coating both due to the challenges of incorporating it into a coating and issues with its influence on the beer itself.

The patent literature suggests various systems for encouraging nucleation. For example, FR2531891 describes making nucleation sites using a laser beam to create a visual effect, like a logo, in the glass. Such a system is at a scale similar to that described above. Similarly, GB2420961A describes laser or sonic etching on a plastic and polycarbonate container.

US2002000678A1, US2010104697A1 and GB2136679A describe forming patterns of nucleation sites, e.g. on the base of a glass. Some of the prior art ensures these patterns are able to reach the top of the liquid. However, there is no description for how to better nucleate gas nor the materials used. Nucleation sites are made at the microscale.

JP62109859 describes a container coating for scavenging oxygen down to scales of 0.01 micrometers thick.

WO9412083A1 describes an etching process and tools for use, but nothing about materials, dimension of sites etc.

WO9500057A1, although mentioning $CO_2$ and mixed gas $CO_2/N_2$, is concerned with a manufacturing process of gas nucleation drinking glasses (e.g. pre-treatment, annealing process, temperature of baking, etc).

DISCLOSURE OF THE INVENTION

The present invention seeks to propose surface structures that are able to promote bubble nucleation and growth in nitrogen supersaturated beverages, such that widgets or other "foam-initiation" mechanisms can be replaced.

It is preferable to create an engineered surface, one in which the surface features have the geometry and energy to promote bubble nucleation and growth. The surface must be able to be incorporated into the dimensions of a standard can serve (e.g. 440 mL).

A successfully engineered surface incorporated into a broad range of substrates (metals, glass and polymers) will expand the range of packaging options for stout beer and related products. An engineered surface allows tailoring of the nucleation activity, thereby accommodating changes to the initiation requirements.

In a broad aspect of the invention there is provided a surface for a beverage package for promoting bubble nucleation and growth that includes a plurality of nanoscale structures.

Particularly, the nanoscale structured surface promotes nitrogen (and mixed gases containing nitrogen) bubble nucleation and growth. This concept was hitherto unknown. Accordingly, the invention can be described as a package for beverages containing nitrogen that includes a plurality of nanoscale structures for promoting nitrogen bubble nucleation and growth.

"Nanoscale structures" in the context of the invention are broadly defined as a magnitude between 1 and 100 nanometers, although practically the structures will be at least greater than 6 nm. Larger structures, e.g. 1 μm and greater are excluded.

The structure may be a dense collection of pillars or pits, most preferably pits. It is likely that an optimum solution will include a surface of 20-100 nm pits. The contact angle range may be 50-80 degrees, i.e. hydrophilic; or alternatively 90-120 degrees or even approaching 155 degrees (hydrophobic). The structure may be random or, more preferably, a defined pattern.

Preferably the nanoscale structures are a defined pattern of pits of 6 to 100 nm or within a sub-range, e.g. 20 to 30 nm in diameter, and greater than 15 nm deep. Preferably the total number of pits will be defined and confined within a known surface area with a specified location on the package. Due to the small individual size there will most likely be billions of nanoscale structures present in a given area of the container wall surface.

According to the invention, the inner surface of a container (e.g. can) is functionalized to produce the required foam initiation for a nitrogen supersaturated beverage. A surface treatment may be readily applied to the container by standard coating methods during manufacturing. Since it is known that surface topography and energy influences the nucleation, growth, and detachment of bubbles in stout beer and champagne, a surface treatment that is engineered to promote bubble formation will facilitate substantial simplification of the canning process (compared to "widget" methods) by eliminating the need for specialized equipment. This potentially enables a reduction in cost for "draught-in-can" stout beer products or, indeed, for any other product that may have a need for gas to come out of solution quickly to produce bubbles and a foamy head.

By virtue of the invention, bubble nucleation and growth is achieved by a surface that promotes formation of trapped gas pockets. Superhydrophobic surfaces are an example of surfaces that can trap gas through the formation of composite liquid/solid/air interfaces.

The solution of the invention involves the formation of a gas-solid-liquid interface. Particularly, it is known that trapped gas is often present on surfaces such as salt crystals, sugar, silica, etc. These materials can promote significant bubble formation when introduced, as dry materials, into beverages such as beer and soda. However, the trapped gas is readily released after wetting with liquid, i.e. the trapped gas will not remain trapped on the surface once the surface (i.e. the inner can surface) is wetted during filling and storage.

Development of the invention requires examination of hydrophobic and superhydrophobic surfaces, especially those containing pits or crevices, which are expected to create gas-solid-liquid interfaces.

In relation to bubble detachment, research has indicated that hydrophobic surfaces with a contact angle from 90-120 degrees require larger bubbles for detachment. Since it takes longer for larger bubbles to grow, the bubble production rate is slower on high contact angle surfaces. Therefore, superhydrophobic surfaces, with a contact angle approaching 155 degrees, have been examined.

There is a range of bubble sizes in a stout beer head, however, a target mean bubble size of approximately 55 μm is needed to form a smooth/fine head on a stout beer. However it is noteworthy that all previous research on Type 4 nucleation has been with $CO_2$, which has a significantly larger bubble size. In this case pre-existing nuclei could be trapped by using microstructured surfaces. Experimental results show that cellulose, which has a multiscale structure, was shown to be successful in promoting Type 4 nucleation.

Development of the present invention involved careful study of surfaces with different feature sizes, from nanoscale to microscale, and determining their effect on bubble growth rate and size.

DETAILED DESCRIPTION OF THE INVENTION

Figure 1:
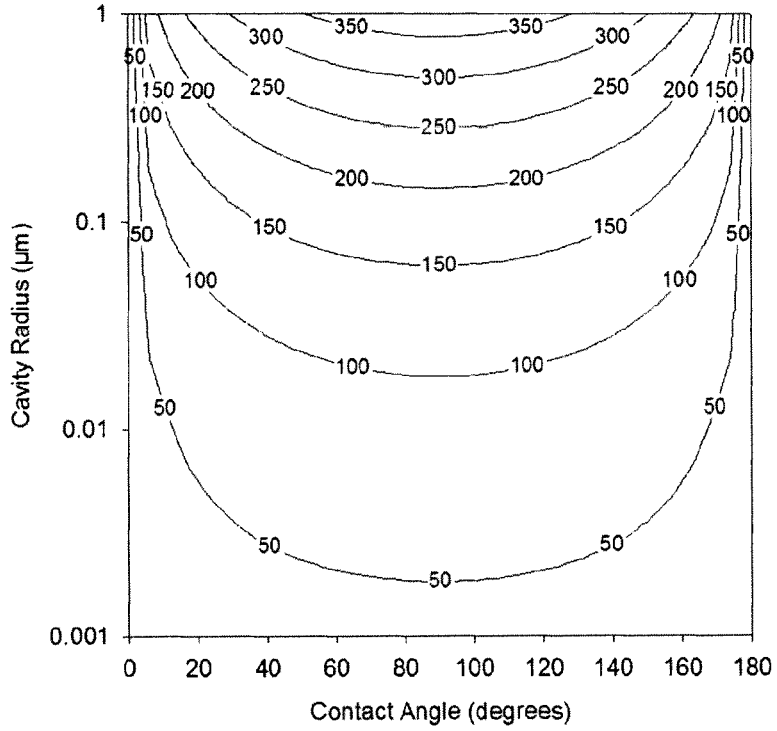
FIGS. 1 to 19 illustrate various experimental results and proposed structures that aid description of the invention. Some of the figures and related description outline experimental results that were assessed as support for the inventive concept, but do not fall within the scope of the invention itself.

According to the invention, the best results are achieved with surfaces having a cavity diameter in the range of 6-100 nm (0.006-0.1 μm) and shallow cavity depth (see FIG. 1). Surfaces at the extreme ends of behaviour, either highly wetting or superhydrophobic were expected to provide the fastest bubble growth. A slight preference was expected towards superhydrophobic (see FIG. 2). Calculations suggest that the target nucleation rate for sufficient foam to form can be achieved with a nucleation site density inside the can of approximately 0.003%, with the assumption that the target bubble rate is $5.3\times10^4$ bubbles/mL·s; Inner surface area of can is 364 $cm^2$ and volume of Beer=441 mL; each site is 100 nm diameter; bubble growth time is 4 s.

FIG. 1 shows a two-dimensional plot describing how the detachment diameter (in μm) for a bubble growing from a cavity depends on the cavity radius and the contact angle of the surface. To achieve 50 μm bubbles in the head of stout beers, the cavity radius must be less than approximately 0.01 μm for contact angles in the range of 10-170°. It is generally accepted that, on solid surfaces, contact angles of less than 90° are hydrophilic, whereas a contact angle of greater than 90° indicates a hydrophobic surface.

Figure 2:
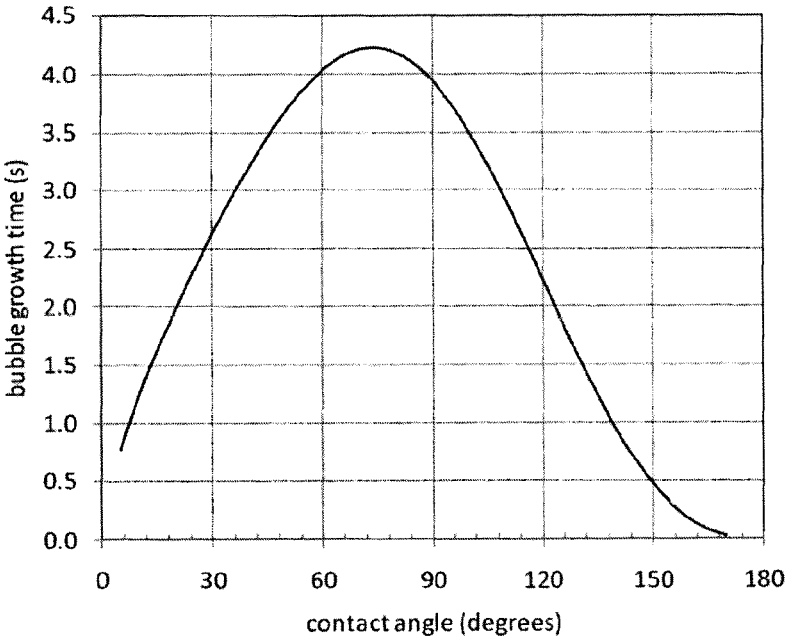

FIG. 2 shows a calculation of bubble growth time using the model described by Jones et al. The time axis describes the time for a bubble to grow and detach from a cavity, using a detachment diameter of 55 μm and level of supersaturation ratio of 2.9. Knowledge of the bubble growth time per site, the total surface area, and the target nucleation rate allows an estimate of the nucleation site density.

To test the inventive concept it was necessary to produce various structured surfaces for experimental purposes.

In the production of microstructure test surfaces, patterns were created by photolithography/etching in Silicon. Patterns can be transferred to other substrates.

Shapes: Pits, Lines, Concentric Circles

Sizes: 10 μm to 70 μm

Surfaces: Si, Cycloolefin Copolymer (hydrophobic), Polylactic Acid (hydrophilic), anodized aluminium oxide.

In the production of nanostructure test surfaces, patterns were created by e-beam lithography in photomask (hydrophobic). Pits and pillars of 50 nm and 25 nm to be evaluated.

Random nanostructured surfaces can be created by embedding nanoparticles into thin layers of polymer cast on Si.

Particles: Nanoparticles and Nanoraspberries

Surfaces: Cycloolefin copolymer

Surface Treatment: PDMS (Polydimethylsiloxane) or Perfluoroalkane (attachment via free epoxy or amine groups)

In the production of microstructures and nanostructures, random nanostructured surfaces can be created by embedding nanoparticles into micropatterned surfaces Shapes: Lines Surfaces: Cycloolefin copolymer Surface Treatment: PDMS or Perfluoroalkane (attachment via free epoxy or amine groups)

Figure 3:
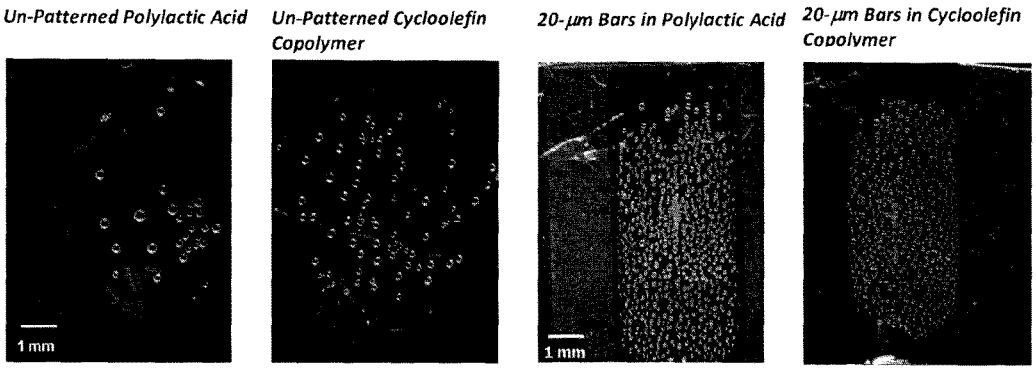

Qualitative screening of experimental test surfaces was performed to assist identifying the most effective embodiment of the invention. All surfaces were pre-screened by placing a droplet of un-nucleated beer on the surface and observing results through a microscope. An example of the experimental procedure of this method is illustrated by FIG. 3.

In most cases, the structured surfaces were significantly more active than the unstructured surfaces. However, structure-property relationships (e.g. structure size, shape and surface energy) could not readily be determined from the qualitative screening method Accordingly a quantitative method was developed in accordance with FIGS. 4 to 6.

Figure 4:
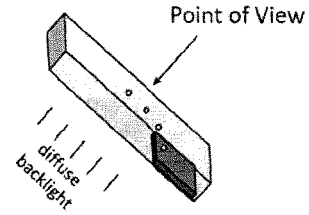
Figure 5:
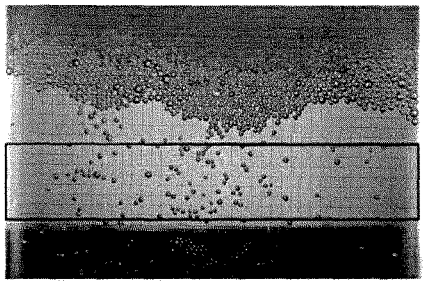

Referring to FIG. 4, a 20 mm×10 mm quartz cuvette was prepared and a sample inserted. By virtue of an incline, bubbles rise to cuvette surface and are captured on video (FIG. 5) to record bubble evolution (adjustable framerate).

Figure 6:
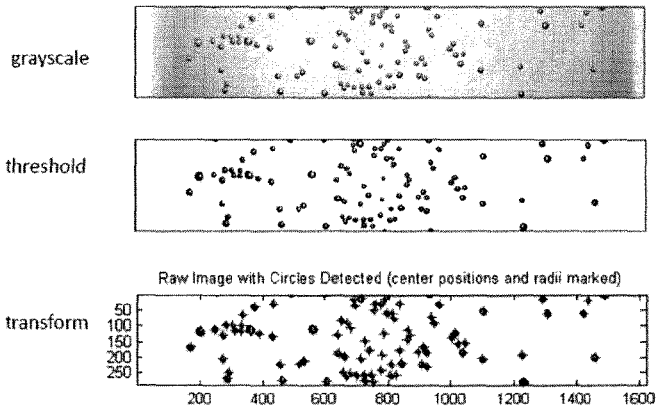

Referring to FIG. 6, these image samples are converted to grayscale, then to a threshold (binary) image to enable identification of bubble boundaries. Finally, a Hough transformation is performed to identify locations (center and perimeter, assumes circular shape).

It was necessary to identify a target rate for bubble formation over time for the screening test. To determine the rate, the number of bubbles in a head was calculated. Initially, the number of bubbles in the head was calculated by using an estimate of 55 μm for the average bubble diameter. Combining this with the required head volume yielded a target rate of approximately 600 bubbles/$mm^2$·s.

However, further testing and some open literature suggested that the average diameter may be closer to 100 μm. In which case:

Bubble diameter=0.1 mm/Bubble volume=$9.05\times10^{-4}$ $mm^3$

Head height=20 mm/Head volume=$9.6\times10^4$ $mm^3$

Packing density=0.64

Bubbles in head=$6.8\times10^7$

It follows that for 441 mL with a surge time of 30 seconds, bubbles need to nucleate and detach at rate of=$5.1\times10^3$ bubbles/mL·sec.

For evaluation of surfaces, the rates must be expressed in units of available inner surface area.

Figures 7, 8:
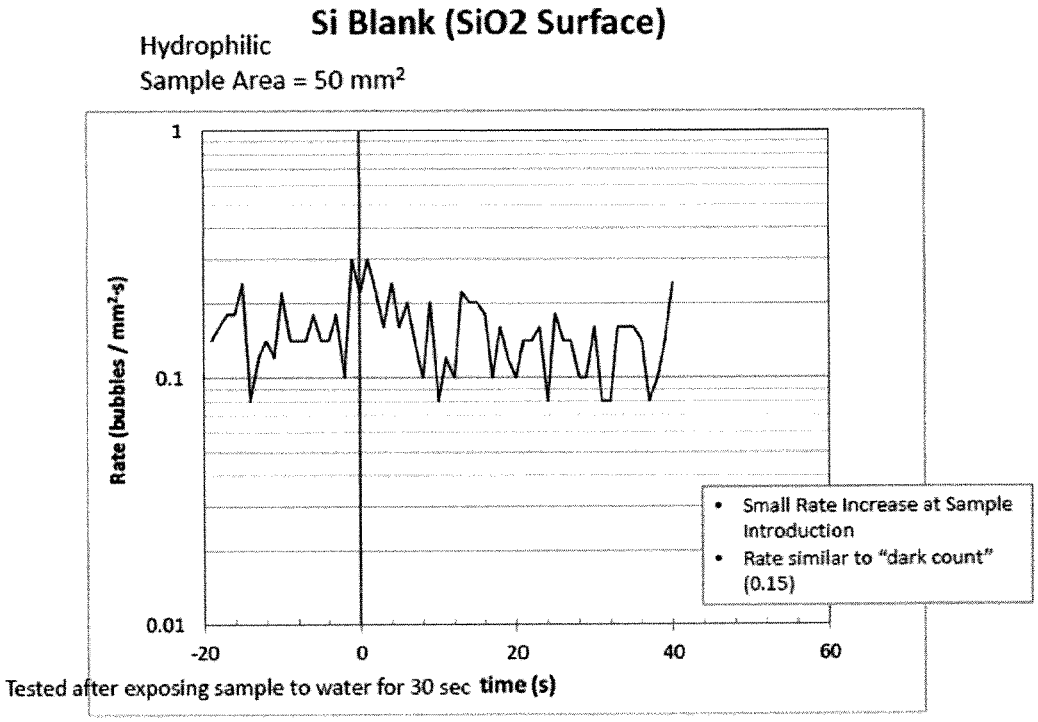
Figure 9:
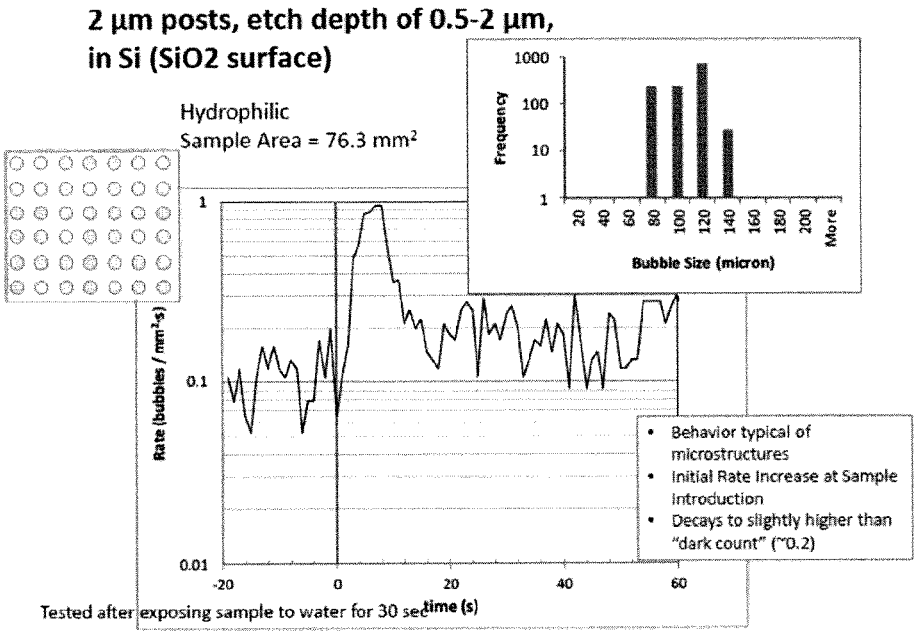
Figure 10:
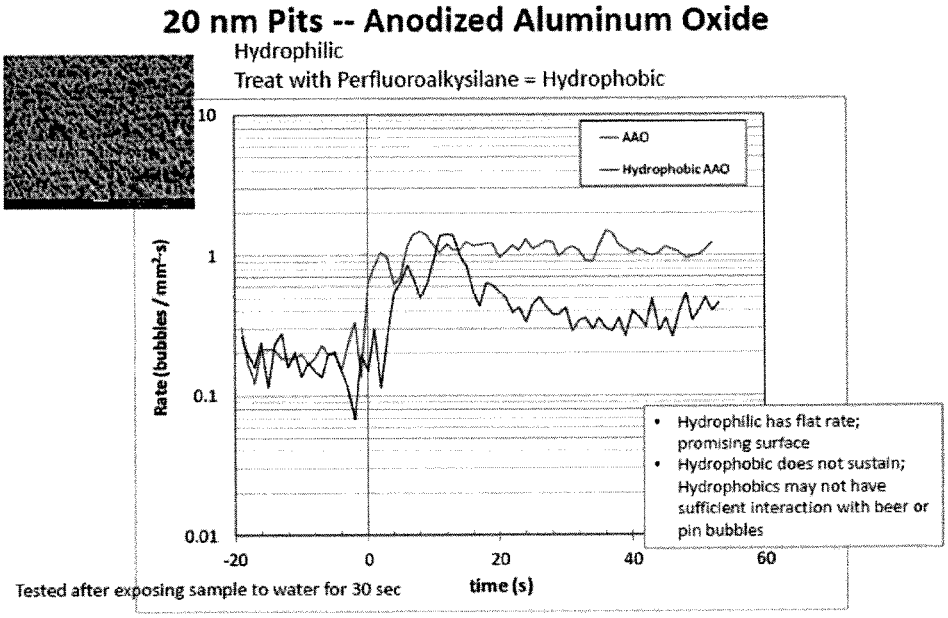
Figure 11:
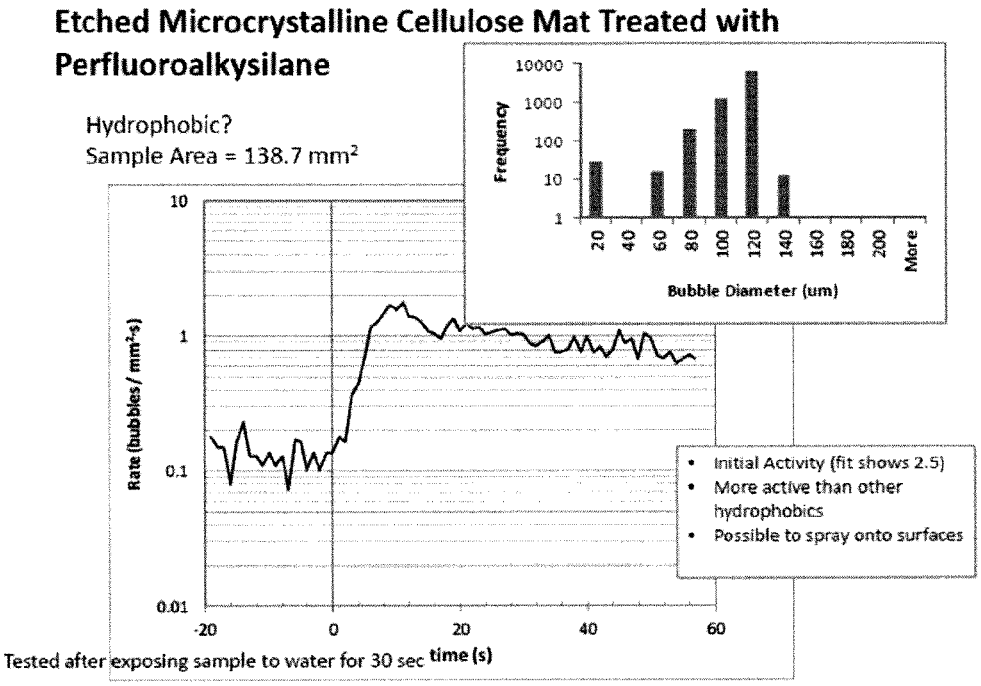
Figure 12:
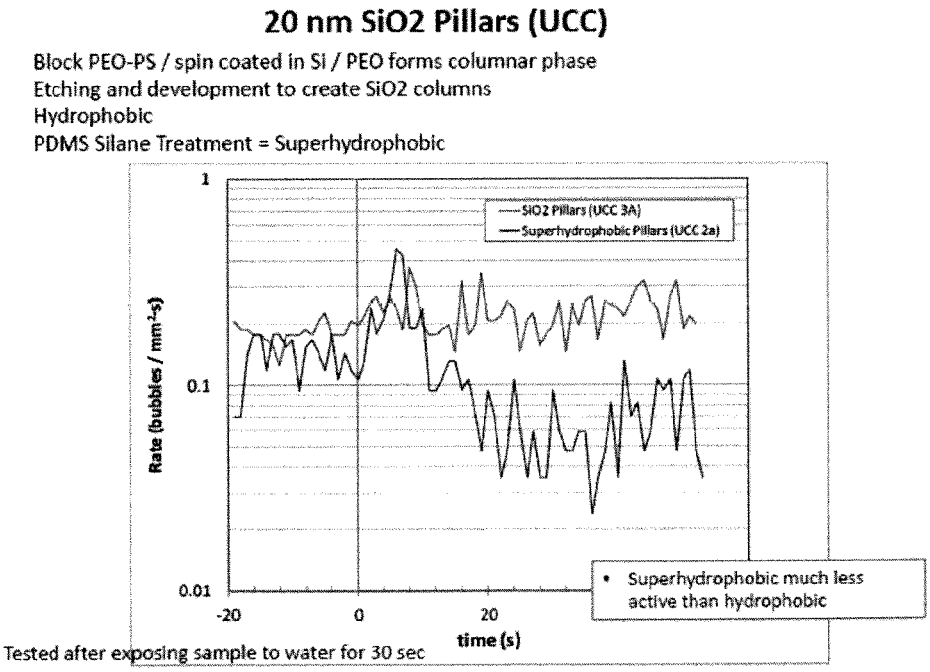
Figure 13:
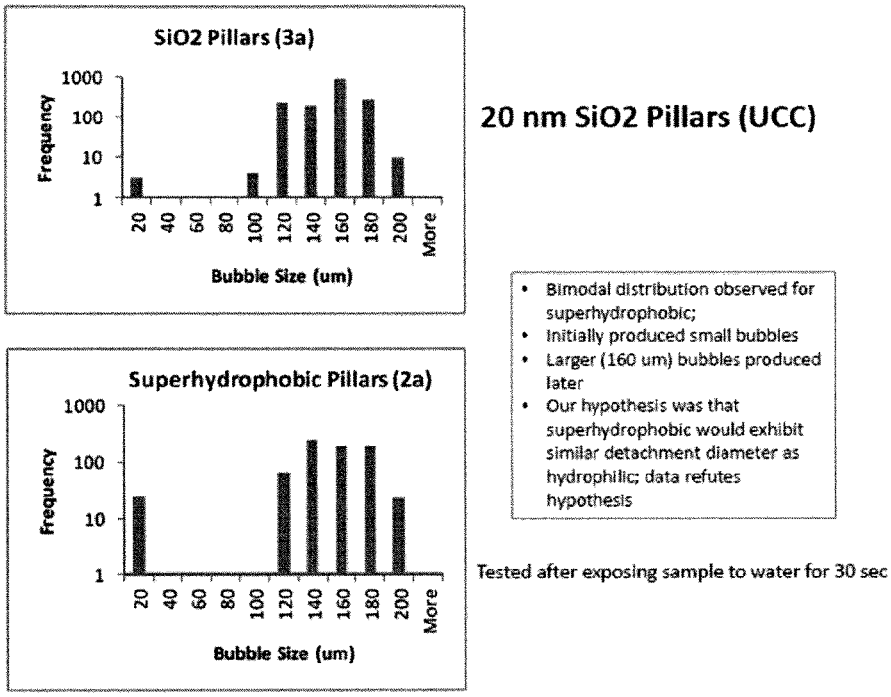
Figure 14:
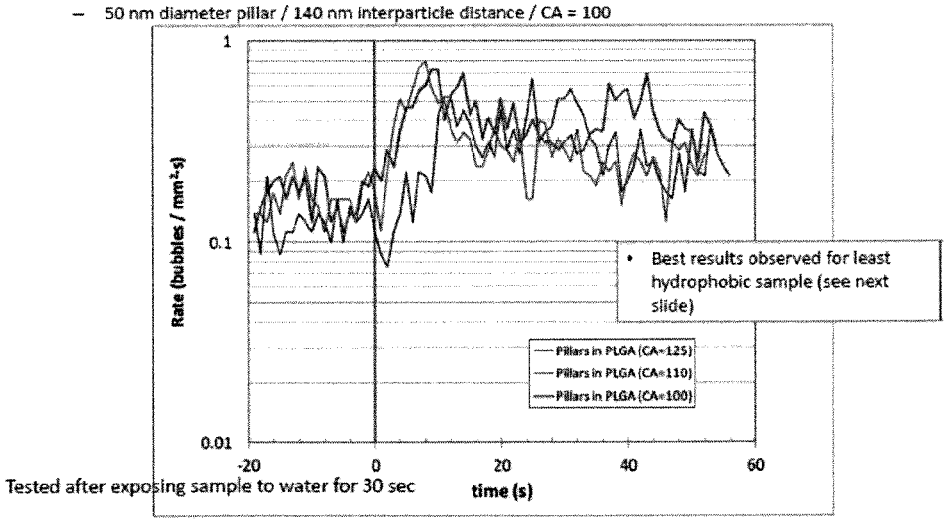
Figure 15:
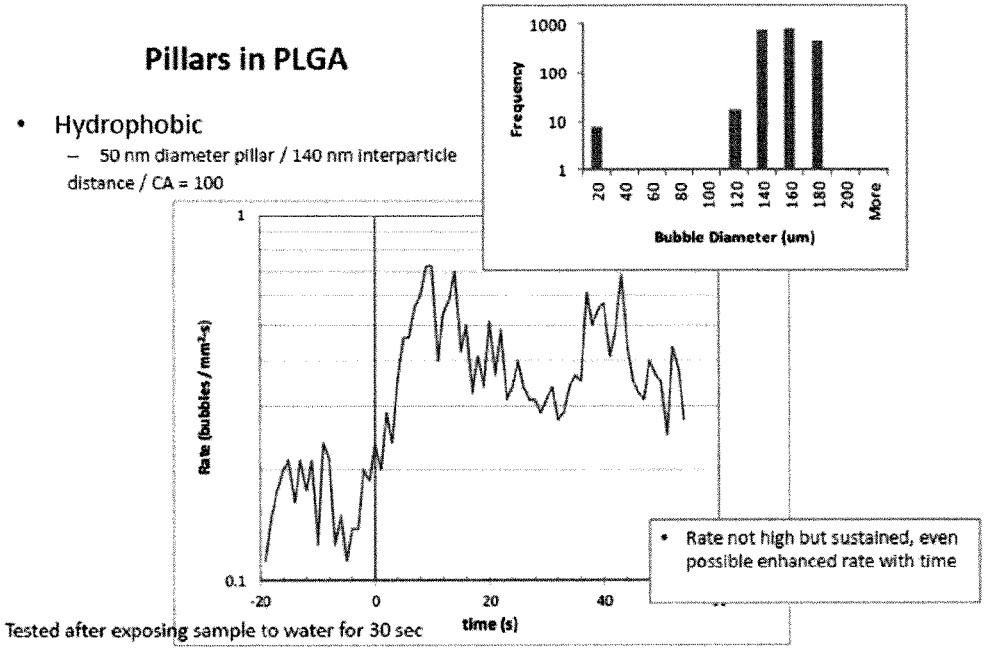
Figure 16:
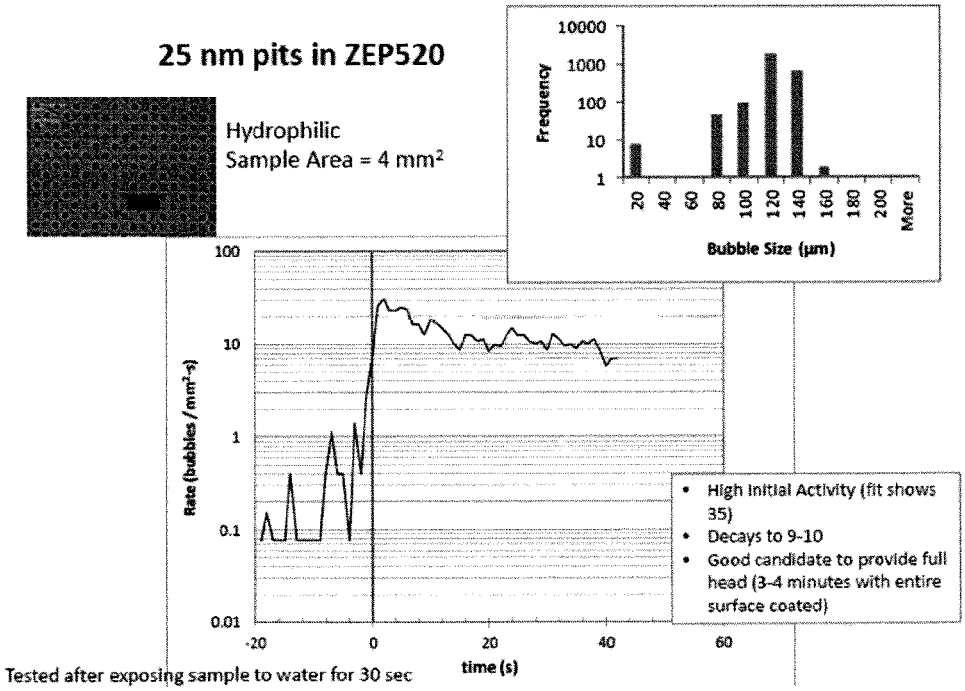

FIG. 7 illustrates target rates based on which part of the can has a structured surface and for how long the exposure to this surface is. However, it does not take into account the effects of pouring the beverage which will have a further influence (via agitation) on head formation.

Experiments for surface structural features on a microscale range, such as 15 μm bars (5-10 μm depth) in Silicon, generally show that bubble growth rates are two orders of magnitude lower than needed to achieve the required head formation. However, this experimentation did confirm that it is important to test samples that have been pre-wetted.

Initial experiments were conducted on surfaces with structural features in the nanoscale range, e.g. embedded nanoparticles (40 nm) and nanoraspberries (micron-sized particles functionalized with nanoparticles) into cycloolefin copolymer (COC), functionalized with perfluoroalkane. These results were inconsistent due to challenges with achieving homogenenous coatings, particularly for patterned COC; nonetheless, the suggestion is that when coverage is moderately good, rates are improved compared to microstructures.

Analysis of over 45 surfaces showed that patterned surfaces are more active (i.e. create more bubbles) than unpatterned surfaces. Higher activity due to the inherent increase in surface area cannot be distinguished from an increase due to Type 4 nucleation.

Although bubble growth is enhanced by patterned surfaces, as mentioned, bubble growth rates for microstructured surfaces are two orders of magnitude lower than the existing estimate of bubble release rate to achieve the required head and bubble sizes are twice as large as is desired. While bubble growth rates for nanostructured surfaces could not initially be adequately characterized due to poor surface coverage of the nanoscale features, early results confirm that these surfaces produce smaller bubbles.

A next series of experimental surfaces were produced. FIGS. 8 to 16 illustrate graphical results for these various test surfaces. The nature of the surface is indicated in the Figures, including notes on the observations.

As a consequence of the test surfaces the following conclusions have been made:

- Nanostructures create surfaces that promote sustained nitrogen (and mixed gases containing nitrogen) bubble nucleation and growth, not just "burst" observed with high surface area powders and microstructures.
- Hydrophilic structures appear to be more effective than superhydrophobic
  - Superhydrophobic surfaces may not interact as well with beer
  - Bubble detachment diameter for superhydrophobics is higher than for hydrophobic and much higher than hydrophilic (whereas a smaller detachment diameter is favourable)
- Pits appear to be more effective than pillars
- Sharp edges may be more effective than rounded In further development of the invention it is proposed to establish the difference between screening rates and actual head formation in a standard pint glass by scaling-up the promising candidates: e.g. AAO (anodized aluminium oxide), etched cellulose; and performing head height testing from a pressurized container (holding pint) and pouring into glass.

The best candidate structure (25 nm pits in ZEP) is to be reproduced using a scalable process. ZEP (zinc ethyl phenyl dithiocarbamate) is a polymer material suitable for marking with electron beam lithography so can be used to create nanostructured surfaces for experimentation, but not likely suitable for commercial application.

Figures 17, 18:
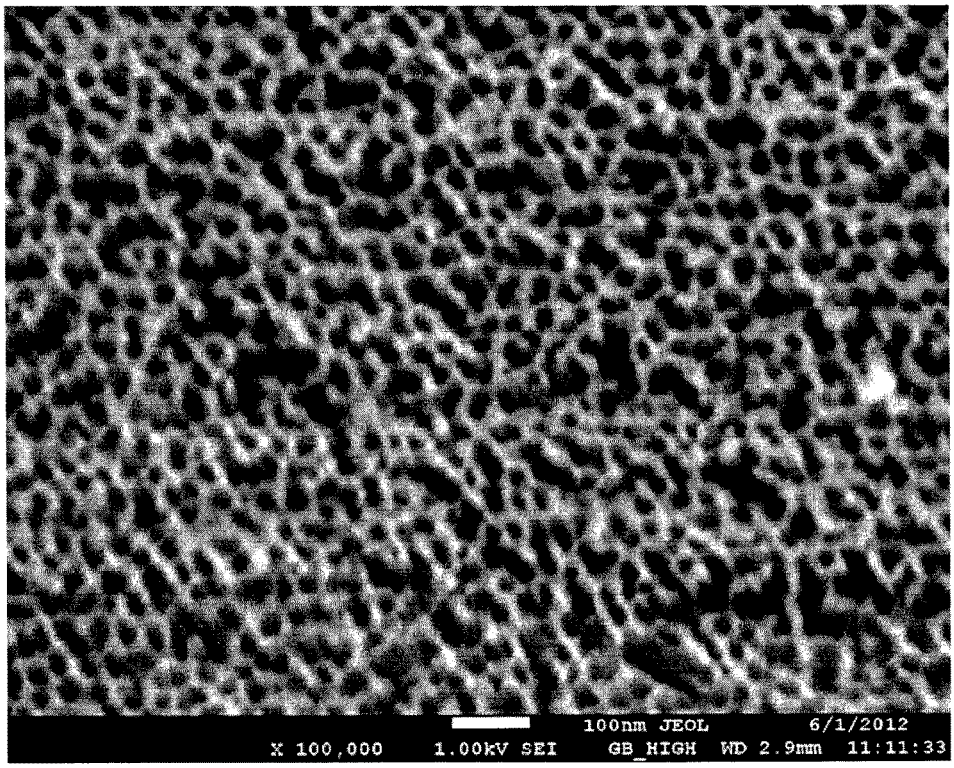

In connection with scaling experimentation, AAO samples (a magnified image of which is illustrated by FIG. 17) have been prepared on aluminum:

- 10 cm×10 cm (100 $cm^2$)
  - Small scale screening showed that these generated bubbles at a rate of ~1 bubble/$mm^2$s.
  - Large scale tested by: placing sample into standard can dimensions (12 oz), waiting 30 seconds, and then pouring into pint glass.

Results are given in FIG. 18 which suggests the target rate may be less than first calculated. This further supports the preferred utilisation of pits, 20 nm deep.

The best mode presently known for implementing the invention involves the following process:

The surface of a can or bottle (or any suitable package) is marked with a defined pattern of ~25 nm diameter pits separated by unmodified can or bottle wall. Preferably the pit will be >20 nm deep. The total number and location of pits is preferably defined and confined within a known surface area within the package. This area may be below the liquid level of a full resting container and may be enhanced by structures which only become wet during the action of opening and pouring the container.

On filling the container with a supersaturated $N_2$ solution in the known way, the pits will remain dry because of surface tension effects in the liquid but the existing gas in them will gradually be replaced by $N_2$ from the liquid. That is to say, when the package is sealed the system will reach equilibrium where the amount of gas in the pits is stable—there is no gas transfer between the pits and the liquid. In practice a mixed gas ($N_2$ and $CO_2$) may be in equilibrium in the pits/cavities; however, the invention is hypothesised to be mainly reliant on $N_2$.

Once the container is opened, the equilibrium is moved so there is excess $N_2$ dissolved in the liquid which comes out of solution into the gas space in each pit. Gas is supplied to the pit by diffusion from the surrounding liquid to a remnant of gas in the pit left by the departure of a preceding bubble. I.e. after release of a first bubble, more gas migrates into the pit and the process of bubble generation continues. A critical radius of the gas bubble is needed for detachment from a site (pit); that occurs when buoyancy overcomes the surface tension force. It is believed that the primary reason for bubble growth as it rises to the stout head is through infusion of gas from the liquid (mainly $CO_2$).

It has been demonstrated that a single pit can continue to generate multiple bubbles, e.g. say 20 per minute. A desirable foamy head requires a very large number of bubbles (which are very small) but, to achieve this, the nanostructure surface provides a very large number of nucleation sites in a small surface area.

Overall, the engineered surface of the invention creates the spontaneous bubble generation phenomenon required upon opening a container which further results in the appearance of liquid draining down between a large mass of slowly rising $N_2$ gas bubbles, leading to the formation of a stable white head on the beer of approximately 18 mm in depth.

Figure 19:
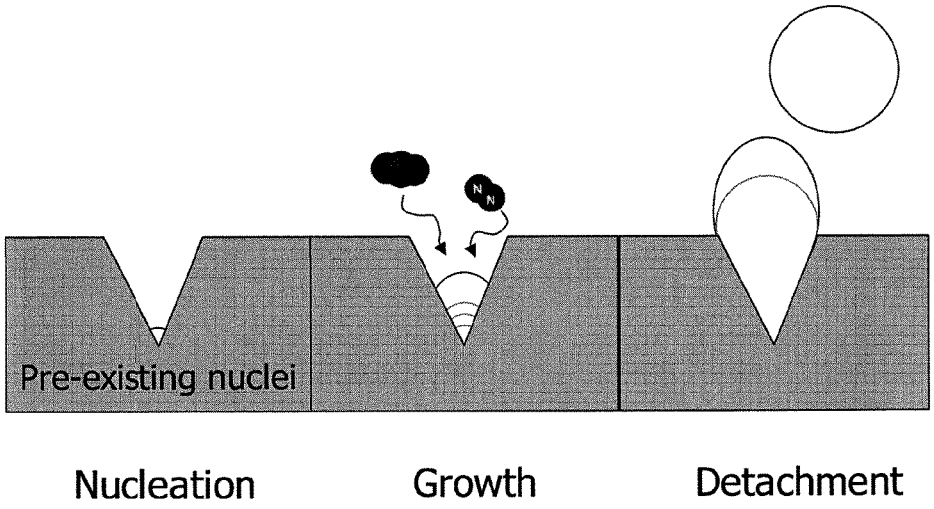

FIG. 19 illustrates the above described process where a pre-existing nuclei is present in a nanoscale pit, followed by migration of $N_2$ and $CO_2$ thereinto which grows a gas bubble and, finally, detachment when the bubble overcomes the surface tension. Nucleation surfaces can work for $N_2$, $CO_2$ and a mixture of both depending on the size of the pits. In the case of stout beer it is likely a mixed gas is present so pit sizes are calculated accordingly.

There may also be an effect from bubbles in the body of the liquid growing from nitrogen migrating into them and then splitting into two and so on. This increases the total number of bubbles generated and is the result of the initial bubble formation.

Generating sufficient foam for a desirable head is partly dependent on how long the liquid is in contact with the engineered surface/wall after opening of a beverage container. For this reason it is foreseen that consumers may be given explicit pouring instructions (e.g. on the side of the package) so the desired result is achieved. Alternatively or additionally, the size of the container opening can be calculated to restrict flow such that a minimum contact time is guaranteed when pouring under gravity, e.g. after opening the container it will take a predetermined time to be completely emptied (possibly up to 30 seconds) by virtue of the opening.

The invention is embodied by the insight to investigate nanostructures, to be incorporated into a package surface, for promoting nitrogen (and mixed gases containing nitrogen) bubble nucleation and growth.

INDUSTRIAL APPLICABILITY

The nanostructures of the invention can be incorporated into adhesive labels or other carriers in order to apply the structured surface to the inside wall of a beverage container or, as is preferred, formed directly onto a surface coating which covers the metal or glass etc.

It is also proposed to use an inverse image AAO (anodized aluminium oxide) material to imprint pillars and pits into hydrophilic polymers. Furthermore, porous material is a good candidate for realizing the invention because surface area can be increased by coating thickness.

The invention claimed is:

1. A beverage container, containing a beverage product with supersaturated nitrogen or a gas mixture with nitrogen in solution, the container including a surface for promoting bubble nucleation and growth that includes a plurality of pits between 6 and 100 nanometers in width.

2. The beverage container of claim 1 wherein the pits only become wet during the action of opening and pouring the container.

3. The beverage container of claim 1 wherein the pits are arranged in a defined pattern.

4. The beverage container of claim 1 wherein the pits are between 20 to 30 nm in width.

5. The beverage container of claim 1 wherein the pits are greater than 15 nm in depth.

6. The beverage container of claim 1, the surface being hydrophilic or hydrophobic.

7. The beverage container of claim 6 wherein the surface has a contact angle of 50 to 80 degrees.

8. The beverage container of claim 1 wherein the approximate total number of pits is defined and confined within a known surface area with a specified location on the container.

9. The beverage container of claim 8 incorporating a closure/opening sized to enable regulation of the egress of liquid from the container to ensure a minimum residence time for said liquid in the container.

10. A method of manufacturing a container for promoting nitrogen bubble nucleation and growth including the steps of:

applying a pattern of pits of 6 to 100 nm diameter, with greater than 15 nm depth, to at least a portion of a beverage contacting wall of the container;

filling the container with a beverage containing supersaturated nitrogen, or a gas mixture containing nitrogen, in solution and sealing the container with a closure means.

11. The method of claim 10 wherein the approximate total number and location of pits is defined and confined within a known surface area or multiple areas within the container.

12. The beverage container of claim 1 wherein the pits are between 20 to 40 nm in width.

13. The beverage container of claim 1 wherein the pits are between 10 to 80 nm in width.

* * * * *